US005709542A

United States Patent [19]

Rentzel et al.

[11] Patent Number: 5,709,542

[45] Date of Patent: Jan. 20, 1998

[54] DEVICE AND METHOD FOR THE COMBUSTION OF OXIDIZABLE CONSTITUENTS IN A CARRIER GAS WHICH IS TO BE CLEANED

[75] Inventors: Gert Rentzel, Gründau; Joachim Saggel, Osnabrück, both of Germany

[73] Assignee: Grace GmbH, Norderstedt, Germany

[21] Appl. No.: 522,228

[22] PCT Filed: Feb. 25, 1994

[86] PCT No.: PCT/EP94/00539

§ 371 Date: Oct. 30, 1995

§ 102(e) Date: Oct. 30, 1995

[87] PCT Pub. No.: WO94/20792

PCT Pub. Date: Sep. 15, 1994

[30] Foreign Application Priority Data

Mar. 2, 1993 [DE] Germany ..... 43 06 417.5

[51] Int. Cl.[6] ..... F23D 11/44

[52] U.S. Cl. ..... 431/242; 431/5; 431/11; 431/215; 431/243; 431/247

[58] Field of Search ..... 431/5, 11, 242, 431/215, 247, 248, 243; 422/177, 176, 203, 204; 126/91 A

[56] References Cited

U.S. PATENT DOCUMENTS 4,850,857 7/1989 Obermuller ..... 431/5

FOREIGN PATENT DOCUMENTS 2 556 446 6/1985 France .
2 248 470 5/1995 France .
361 904 6/1962 Switzerland .

*Primary Examiner*—James C. Yeung
*Attorney, Agent, or Firm*—Nields, Lemack & Dingman

[57] ABSTRACT

The invention relates to a process and a device for burning oxidizable components in a vehicle gas to be purified, comprising a gas inlet (36), a burner (19) with an attached flame pipe (22) opening into a main combustion chamber (24) comprising a bottom and side walls, an annular chamber leading from the side of the main combustion chamber bottom (21), a heat exchanger (32) around which flows the purified gas and through which flows the gas to be purified, and a gas outlet (38). To obtain good combustion with a compact construction, especially to make the best possible use of the geometric dwell time in the main combustion chamber, it is proposed that the main combustion chamber be constructed in such a way and/or has such guide components (40,42,44) that the gas flowing from the bottom towards the annular chamber is distributed completely or largely uniformly over the cross-section of the main combustion chamber.

14 Claims, 2 Drawing Sheets

Figure 1:
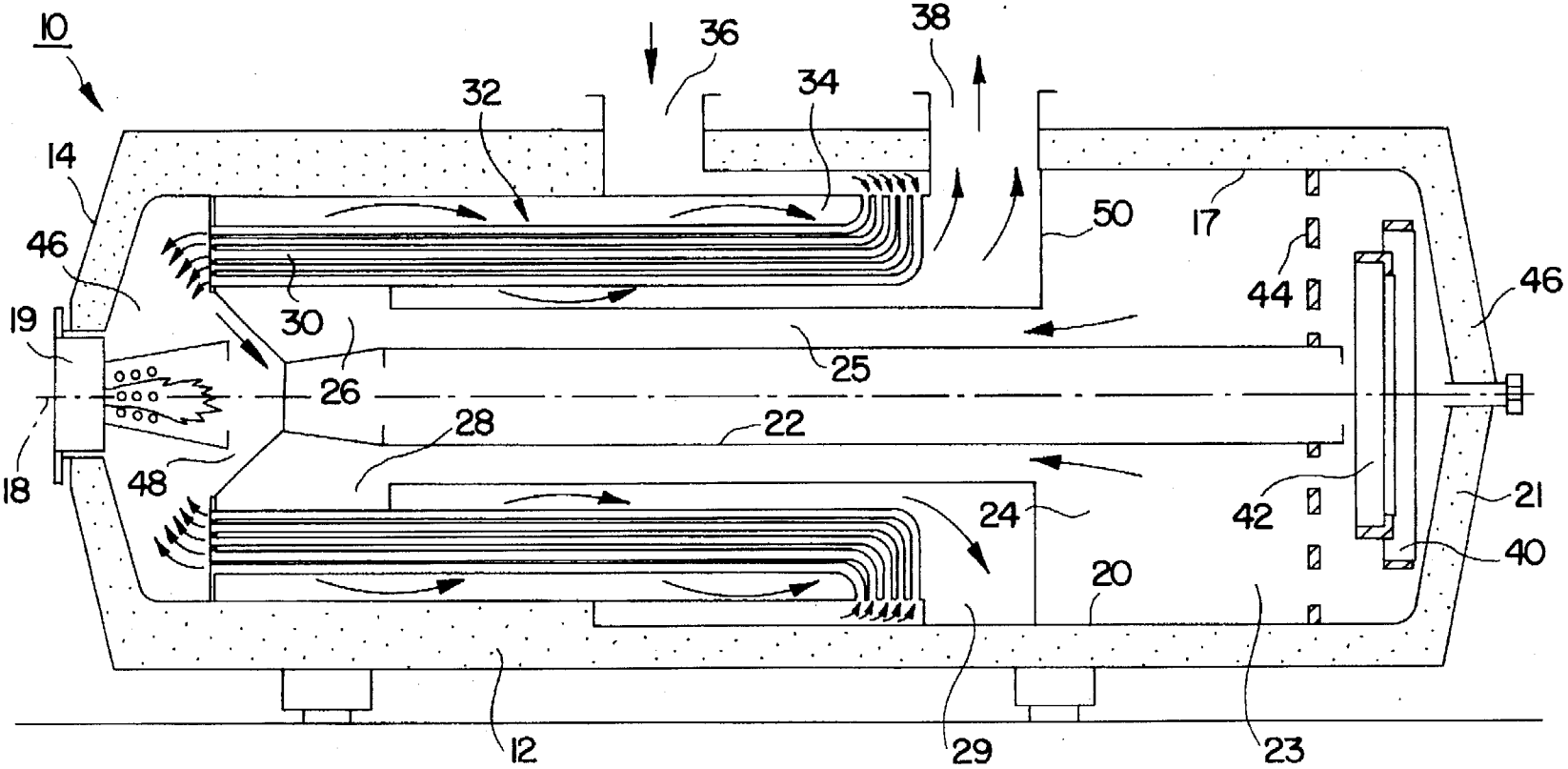

DEVICE AND METHOD FOR THE COMBUSTION OF OXIDIZABLE CONSTITUENTS IN A CARRIER GAS WHICH IS TO BE CLEANED

The invention relates to a device for the combustion of oxidizable constituents in a carrier gas to be cleaned, comprising a gas inlet, a burner with attached flame tube, which opens into a main combustion chamber comprising bottom and side walls, a combustion chamber outlet preferably on the side wall opposite the bottom wall of the main combustion chamber, a heat exchanger and a gas outlet.

In addition, the invention relates to a method for the combustion of oxidizable constituents in a carrier gas which is to be cleaned in a device consisting of a main combustion chamber starting from a flame tube and limited by bottom and side walls, in which cleaned gas is diverted from the bottom wall in the direction of a combustion chamber outlet placed coaxially radially or tangentially with respect to the flame tube.

A device of the type described above can be seen in EP 0 235 277 B1. The flame tube of this device, which is termed a high-speed mixing chamber, opens into the main combustion chamber, cross section of which is larger than the free the cross section of flow in the high-speed mixing chamber. The main combustion chamber extends on the outside along the high-speed mixing chamber, which is in the form of a tube. It then changes into a ring-shaped channel running coaxially to the high-speed mixing chamber, which is in the form of a tube. It then changes into a ring-shaped channel running coaxially to the high-speed mixing chamber, which itself changes into a further channel-type annular space also placed around the high-speed mixing chamber and partly around the ring-shaped channel. A heat exchanger is located in the annular space whose tubes are bent outwards at their colder ends.

In other known systems, the main combustion chamber, the flow section of which is also larger than that of the high-speed mixing chamber, extends completely along the high-speed mixing chamber and then preferably ends radially in a heat exchanger, which is preferably arranged in a ring-shaped channel.

Installations in which the heat exchanger is accomodated in a seperate housing are also known.

In all these known combustion systems, the gas leaves the high-speed mixing chamber in the form of a free jet. This jet impinges on the bottom wall of the main combustion chamber and is distributed there in a rotationally symmetrical manner corresponding to the flow geometry of the baffle plate flow. High centrifugal forces cause the gas to flow both along the bottom wall and, after a further diversion, like a ring jet axially along the inside surface of the side wall of the combustion chamber. The cross section surface of this ring jet along the side wall of the main combustion chamber up to the combustion chamber outlet increases only slightly, so that a stationary vortex area forms between the ring jet and the outside wall of the high-speed mixing chamber. This results in less than optimum utilization of the main combustion chamber, because of the very wide residence time distribution of the gas as a result of vortex formation. This means that the minimum residence time of the gas in the main combustion chamber is considerably less than the theoretical residence time, which is calculated as the quotient of the volume of the main combustion chamber and the gas flow in it.

From FR-A-2 248 470 it is known a device for burning oxidizable constituents in a carrier gas to be cleaned, which is in line with EP 0 235 271 B1 except that the combustion chamber has profile rings outside both to hold back material which cannot be burnt and to increase as much as possible the residence time of the solid particles which can be burnt. This results in the formation of stationary turbulences in the section of the profile rings, thus causing a reduction of the effective cross section of the gases flowing through the combustion chamber. The residence time of the respective gases caused by this requires an increased temperature of the combustion chamber to burn the oxidizable constituents in the carrier gas to the necessary extent.

The present invention is based on the problem of how to further develop a device or method of the type described above in such a way that the volume of the main combustion chamber is used in an optimum manner to combust the oxidizable constituents in the carrier gas.

With regard to the device, the task is essentially solved by the fact, that at least one deflecting element directing the flow is arranged in the main combustion chamber, and the deflecting element distributes the gas leaving the flame tube and flowing in direction of the combustion chamber outlet over the entire cross section of the main combustion chamber, an equidirectional flow of the gas occurs and the combustion is uniform over the cross section of the main combustion chamber.

The deflecting element may be a baffle plate, perforated plate and/or a guiding ring or a similar flow-distributing device such as reflector cones, conical baffle plates, and guide vanes. Preferably at least two deflecting elements are placed in the main combustion chamber.

One embodiment of the invention provides for the deflecting element to be shaped symmetrically as a plane in which the longitudinal axis of the main combustion chamber runs. In particular, the deflecting element can be shaped so that it is rotationally symmetrical to the longitudinal axis.

Also, the deflecting element may be a screen such as a resistance grid.

The deflecting element or elements are preferably placed between the outlet of the flame tube and the bottom wall of the main combustion chamber. The deflecting elements may also be placed coaxially around the flame tube or deflecting elements may be placed both between the outlet of the flame tube and the bottom wall and coaxially with the flame tube.

In accordance with the teaching of the present invention, a distribution of the flow of the gas mixture takes place in the entire main combustion chamber. The device in accordance with the invention has the particular advantage that a clear reduction in the main combustion chamber temperature and a reduction in the main combustion chamber volume can be achieved while the residual concentration of oxidizable constituents in the cleaned carrier gas remains the same-or the residual concentration is reduced while the main combustion chamber temperature remains the same and the main combustion chamber volume remains the same.

With regard to the method, the invention is characterized in that particularly the partially cleaned gas diverted from the bottom wall in the direction of the combustion chamber outlet is directed in such a way that the flowing gas is distributed equally across the cross section of at least a section of the main combustion chamber. This particularly means that the diverted gas can be basically directed to the combustion chamber outlet while remaining free of turbulence and return flow. This results in complete utilization of the combustion chamber and prevents more completely cleaned gas from mixing with less completely cleaned gas.

Futher details, advantages and characteristics of the invention result not only from the claims, from the features which can be derived from them—in themselves and/or in combination—but also from the following description of the preferred embodiments which can be seen from the drawings.

Figure 2:
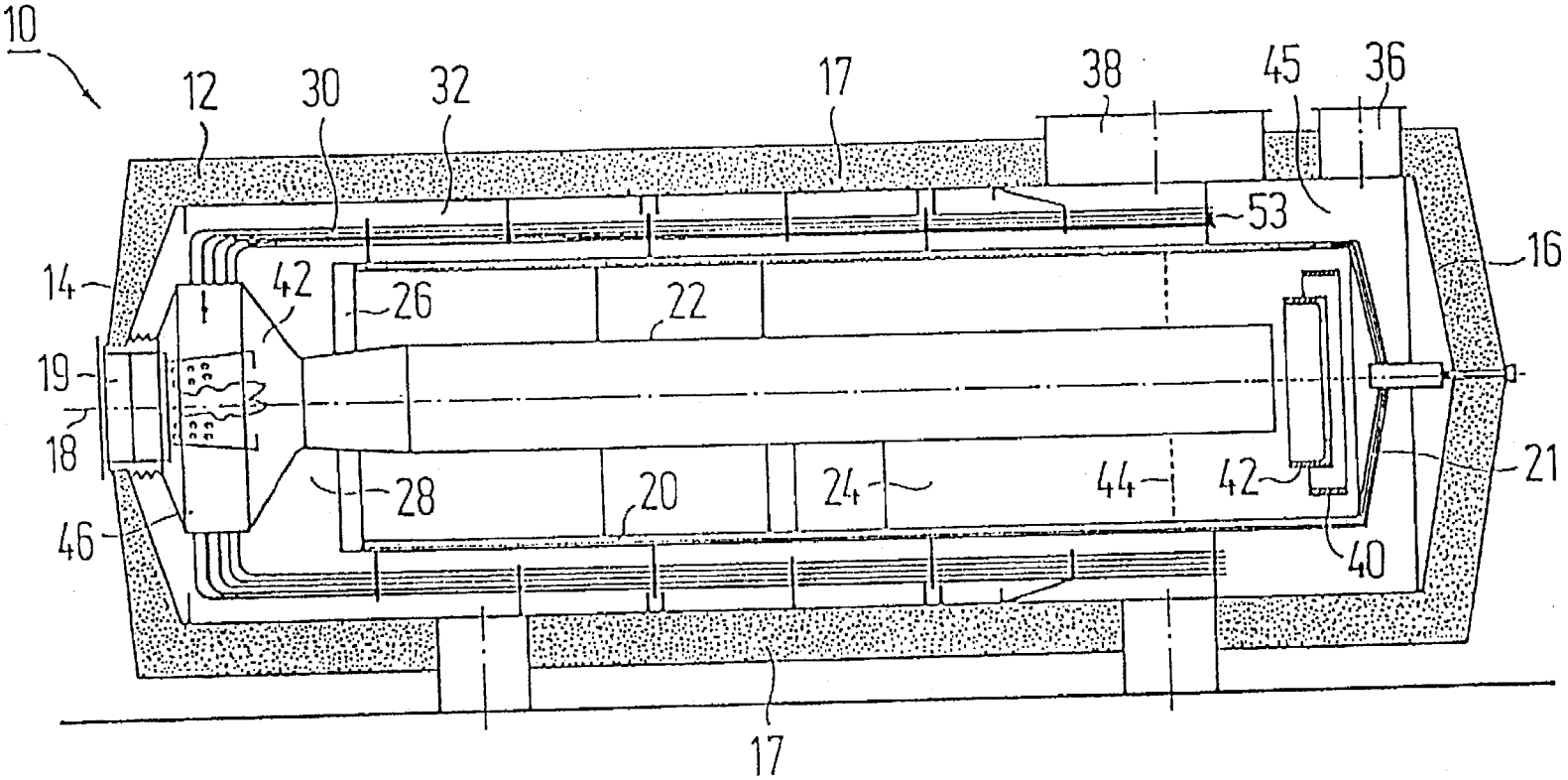

The following are shown:

FIG. 1 a first embodiment of a device for the combustion of oxidizable constituents in a carrier gas to be cleaned and FIG. 2 a second embodiment of a device.

In FIGS. 1 and 2, devices are shown for the combustion of oxidizable constituents in a carrier gas to be cleaned which can also be termed afterburning devices. The devices (10) involve a cylindrical outer casing (12), which is limited by the front walls (14) and (16). In FIG. 1, one front wall (16) is at the same time the bottom (21) of a main combustion chamber (24), while in FIG. 2 the front wall limits an inlet annular space (45) whose opposite wall is at the same time the bottom (21 ) of a main combustion chamber (24).

In the region of the front wall (14) in each case, a burner (19) is placed concentrically to the longitudinal axis of the device. Attached to this are a flame tube (22) preferably designed as a high-speed mixing chamber, and the main combustion chamber (24). It is not absolutely necessary for the flame tube (22) to extend into the main combustion chamber. (24).

In the example given in FIG. 1, the main combustion chamber (24) is subdivided into a first section (23) with a large cross-sectional area and a second section (25) with a small cross-sectional area. The first section (23) is arranged annularly with respect to the axis (18) of the device (10) and limited by the front wall (16), by sections (17) of the outer casing (12) and by an intermediate wall (50). The second section (25) of the main combustion chamber is an annular space around the flame tube (22), starting from the intermediate wall (50) and ending in a further annular space (28), in which heat exchanger tubes (30) of a cross counterflow heat exchanger (32) are placed concentrically to the axis (18) of dee device (10), and thus also concentrically to the flame tube (22). The heat exchanger tubes (30) lead into an outer annular space (34) bordering the outer wall (12), in which there is an inlet (36). Between the outer annular space (34) and the front wall (16) limiting the main combustion chamber (24), the annular space (28) with the heat exchanger tubes (30) ends in an outlet (38), which penetrates the outer wall (12) of the device (10).

In the embodiment shown in FIG. 2, the flame tube (22) is completely surrounded by the main combustion chamber (24) and opens directly and in a radial manner into an annular space (28) arranged concentrically to the axis (18) of the device (10), where the heat exchanger tubes (30) are located. The heat exchanger tubes (30) lead on the other side into the inlet annular space (45) inside the outer casing (12). The inlet annular space is limited by a section of the outer casing (12), the bottom on the front (16), the combustion chamber bottom (21), sections of the casing (20) surrounding the main combustion chamber (24) and an intermediate wall in the shape of a tube bottom (53), and it has an inlet shaped in the form of a nozzle (36) for the carrier gas.

In accordance with the invention, deflecting elements (40), (42), (44) are placed in the main combustion chambers (24) which result in a uniform, basically equidirectional flow over the entire cross sections of the main combustion chambers (24) and over the cross sections of the individual sections of the main combustion chambers (24).

The deflecting elements may direct the flow both by means of low form drags and by means of large form drags. For example, the deflecting elements (40) and (42) in the form of a guiding ring or a baffle plate may create low form drag, and on the other hand deflecting elements (44) in the form of perforated plates or resistance grids or in the form of screens may create a large form drag.

In order to obtain the effect in accordance with the invention, the deflecting elements, particularly the deflecting elements (40) and (42), have to be shaped in such a way that a shearing of partial volume flows of the rotationally symmetrical flow to the bottom (21) of the main combustion chamber (24) and a diversion by 90° in the direction of the combustion chamber outlet (26) is caused.

The deflecting element (44) which surrounds the end region of the flame tube (22) in each case in the embodiments in the form of a perforated plate, a resistance grid, screen or something of the like, constitutes high flow resistance, which causes a distribution of the flow formed on one side on the outer casing of the main combustion chamber (24) over the entire cross section of the main combustion chamber as a result of the high velocities in the free cross sectional areas present in the deflecting element.

As an example of the combustion of pollutants in a carrier gas with the device according to the invention (10), the following will describe the process in the device as depicted in FIG. 1.

Pollutant-contamined crude gas, i.e. carrier gas containing oxidizable constituents, enters the device (10) through the gas inlet shaped in the form of inlet nozzle (36), is directed through the heat exchanger tubes (30) arranged concentrically around the flame tube (22), exits from the heat exchanger (32) in a chamber placed coaxially with respect to the burner (19) and limited by the front wall (14), and is at least partly directed past the burner (19). While the gas is flowing through the heat exchanger (32), preheating takes place by heat absorption via the heat exchanger tubes (30) from the gas which has left the main combustion chamber (24) and is flowing around the heat exchanger tubes (30).

A part of the preheated pollutant-contaminated crude gas comes into contact with the flame of the burner (19) and functions as combustion gas. The other part flows past the burner (19) and past the flame.

Due to the high flow velocities v with v>60 m/s in full load operation in the flame tube (22), the gases from the hot core of the burner (19) are mixed with the colder so-called annular gap flow of the gas, which is directed over a gap (48), which limits the chamber (46) on the burner side, past the burner to the end of the flame tube (22). This initiates the combustion of the pollutants in the entire crude gas. The crude gas with the pollutants, which are already reacting, enters the first section (23) of the main combustion chamber (24) and is distributed there by the deflecting elements (40) and/or (42) and/or (44) acting to direct the flow. Distribution takes place over the entire flow cross section of the main combustion chamber (24), so that a flow in the same direction occurs and the combustion takes place uniformly over the cross section of the main combustion chamber.

As virtually the entire length of the flame tube (22) is necessary in order to mix the colder annular flow flowing over the gap (48) and directed past the burner (19) in the flame tube with the hotter core flow, which is directed through the burner (19), and for this reason there is a temperature difference between the flame tube wall inside and the flame tube wall outside, there is a heat exchange between the hot carrier gas in the second section (25) of the main combustion chamber (24) and the colder uncleaned carrier gas in the flame tube (22). Consequently, the flame tube (22) functions as an additional heat exchanger area. The heat exchange causes a temperature difference of 20° C. and 60° C. in stationary operation between the inlet in the second section (25) of the main combustion chamber (24) and the outlet (26) out of the main combustion chamber, i.e. the inlet into the annular space (28), in which the heat exchanger (32) is placed.

The cleaned carrier gas is then directed around the heat exchanger tubes (30) of the tubular heat exchanger (32), conveys heat to the carrier gas which is to be cleaned and is conducted to the gas outlet (38), which is also shaped in the form of a nozzle.

We claim:

1. Device for the combustion of oxidizable constituents in a carrier gas to be cleaned, said device comprising gas inlet means, burner means having an attached flame tube in communication with a main combustion chamber having bottom and side walls, combustion chamber outlet means, heat exchanger means, and gas outlet means, wherein said main combustion chamber comprises deflecting means for distributing the gas leaving said flame tube in the direction of said combustion chamber outlet means over the entire cross section of said main combustion chamber.

2. The device of claim 1, wherein said deflecting means comprises a baffle plate.

3. The device of claim 1, wherein said deflecting means comprises a perforated plate.

4. The device of claim 1, wherein said deflecting means comprises a guide ring.

5. The device of claim 1, wherein said deflecting means comprises guide vanes.

6. The device of claim 1, wherein said deflecting means comprises at least two deflecting elements.

7. The device of claim 1, wherein said main combustion chamber has a longitudinal axis, and wherein said deflecting means is shaped symmetrically to a plane in which said longitudinal axis of said main combustion chamber runs.

8. The device of claim 1, wherein said main combustion chamber has a longitudinal axis, and wherein said deflecting means is shaped in a rotationally symmetrical manner with respect to said longitudinal axis of said main combustion chamber.

9. The device of claim 1, wherein said deflecting means is selected from the group consisting of a screen, a resistance grid, a perforated plate and a static mixer.

10. The device of claim 1, wherein said deflecting means comprises at least two different deflecting elements causing form drag.

11. The device of claim 1, wherein said flame tube has an outlet, and wherein said deflecting means is placed between said outlet and said bottom wall of said main combustion chamber.

12. The device of claim 1, wherein said flame tube has an outlet, and wherein said deflecting means is placed between said outlet and said side wall of said main combustion chamber.

13. A method of combusting oxidizable constituents in a carrier gas to be cleaned in a device comprising a main combustion chamber having a cross section and defined by bottom and side walls, a flame tube in communication with said main combustion chamber, said combustion chamber having a combustion chamber outlet, said cleaned gas being diverted by said bottom wall in the direction of said combustion chamber outlet, said method comprising directing said gas diverted by said bottom wall over said cross section of said main combustion chamber such that said gas flows and is substantially uniformly distributed over said cross section.

14. The method of claim 13, wherein said gas diverted is directed to said combustion chamber outlet essentially free of turbulence.

* * * * *